United States Patent [19]

Heath

[11] 4,088,719

[45] May 9, 1978

[54] DEVICE AND METHOD FOR FORMING A STRUCTURE, AND A STRUCTURE FORMED THEREBY

[76] Inventor: Jesse M. Heath, 5792 Evergreen Ave., Portage, Ind. 46368

[21] Appl. No.: 779,434

[22] Filed: Mar. 21, 1977

[51] Int. Cl.[2] ..... F27D 1/16

[52] U.S. Cl. ..... 264/30; 52/227; 264/228; 264/269; 266/281

[58] Field of Search ..... 264/30, 228, 269; 266/281; 254/67; 52/227

[56] References Cited

U.S. PATENT DOCUMENTS

| | | | |
|---|---|---|---|
| 369,168 | 8/1887 | Deering | 52/227 |
| 852,835 | 5/1907 | Halstead | 52/227 |
| 1,316,297 | 9/1919 | Gold | 264/30 |
| 1,645,011 | 10/1927 | Kinney | 264/30 |
| 3,246,442 | 4/1966 | Sauer | 264/30 |
| 3,458,641 | 7/1969 | Perucchetti | 266/281 X |

*Primary Examiner*—Thomas P. Pavelko
*Attorney, Agent, or Firm*—Beveridge, De Grandi, Kline & Lunsford

[57] ABSTRACT

Radially constrained arcuately arranged modules such as bricks are placed under compression by a device placed in a space between two of the modules, and a hardenable material is cast in the space to embed the compression device.

The compression device has an elongated member provided with pivoted module-engaging feet at its opposite ends. The elongated member is extensible to move the feet apart and apply compressive retention forces to the modules.

2 Claims, 6 Drawing Figures

DEVICE AND METHOD FOR FORMING A STRUCTURE, AND A STRUCTURE FORMED THEREBY

BACKGROUND AND SUMMARY

This invention relates to a device used for retaining bricks or similar structural modules in position by applying a compressive force thereto, to a method of forming a structure of modules by using such a device, and to the resultant structure.

A typical and preferred use of the device is in lining rigid metal pipe with brick as in smokestacks, furnaces and the like. Presently, such structures are made by filling substantially the entire 360° extent of a rigid exterior shell with a pattern of bricks. This is a demanding task requiring considerable experience and skill, as it is necessary to cut the final bricks in the pattern to precise thicknesses and angles. This is done with a saw which sometimes requires as many as three cuts for each circumferential set of bricks.

The present invention eliminates the need for precision cutting of the final bricks placed within the shell. This is accomplished by placing a compression device in a space between the final two bricks in the pattern. The compression device is elongated, extending its length to compress the bricks together, holding them firmly against each other and against the concave interior surface of the shell. Finally, the space is filled with a hardenable fluent material which is then permitted to harden with the compression device embedded therein.

The compression device includes an elongated member provided at its opposite ends with feet which face outwardly in opposite directions to engage frictionally the adjacent bricks. Means are provided for extending the length of the elongated members to change the distance between the feet and to urge the feet into frictional compressive contact with the spaced apart bricks. At least one of the feet is pivotally connected to the elongated member to accommodate angular differences between the adjacent brick. Reinforcement means extend from the elongated member for embedment in and reinforcement of the body of material which is cast and hardened thereabout.

The following United States patents were considered prior to the preparation of this specification: U.S. Pat. Nos.

807,935—Jackson
1,223,926—Anderson
2,328,069—Kurtz
2,610,470—White
2,612,675—Wread
2,696,359—Hill
2,921,772—Boyd
2,930,096—Haber
3,378,965—Broquist
3,965,630—Roberts
3,965,637—Brusa.

BRIEF DESCRIPTION OF A PREFERRED EMBODIMENT

Figure 1:
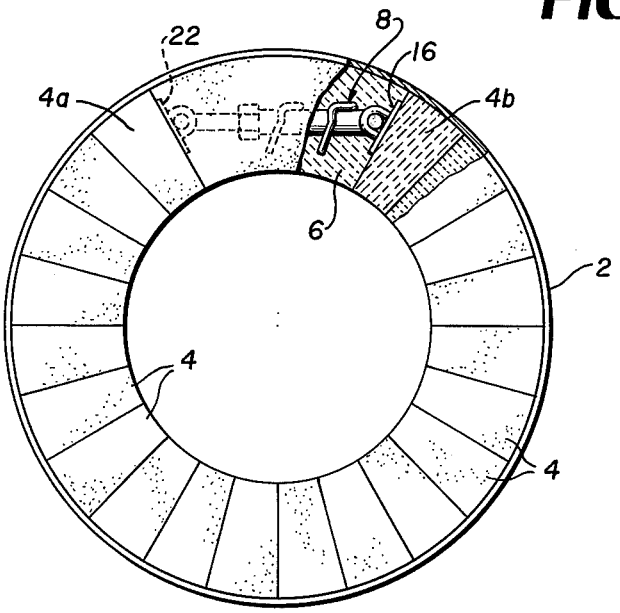
FIG. 1 shows a brick-lined pipe constructed according to and by utilization of the present invention, showing the compression device embedded in a solidified body of cast material.

FIG. 1 shows a pipe shell 2 formed of steel or other substantially rigid material, surrounding a circular array of bricks 4, the latter being structural modules which lie in an arcuate pattern and are radially constrained against the concave interior surface of the shell 2. Two of these bricks, designated 4*a* and 4*b*, are spaced apart, with the intervening space being filled by a body 6 of hardened cast material such as a castable refractory or a ram type plastic refractory.

Embedded in the body 6 of refractory material is a compression device 8, the details of which are discussed below in connection with FIGS. 2–4. Prior to the casting of body 6, the compression device 8 retains the bricks 4 in position within the shell 2 as will be described below.

Figure 4:
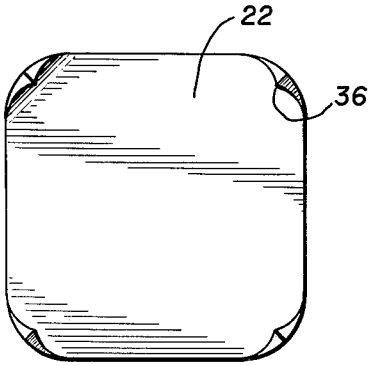
FIG. 4 is an end view of one of the feet of the device of FIG. 2.
Figure 2:
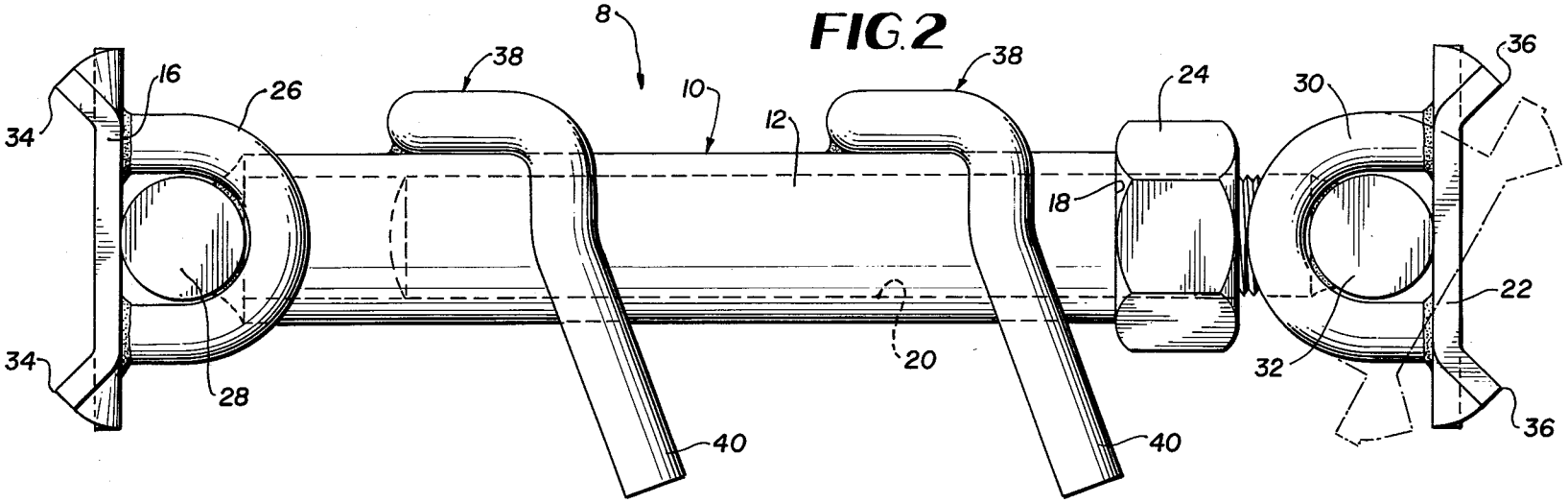
FIG. 2 is a side view of the compression device constructed according to and used in connection with the invention.
Figure 3:
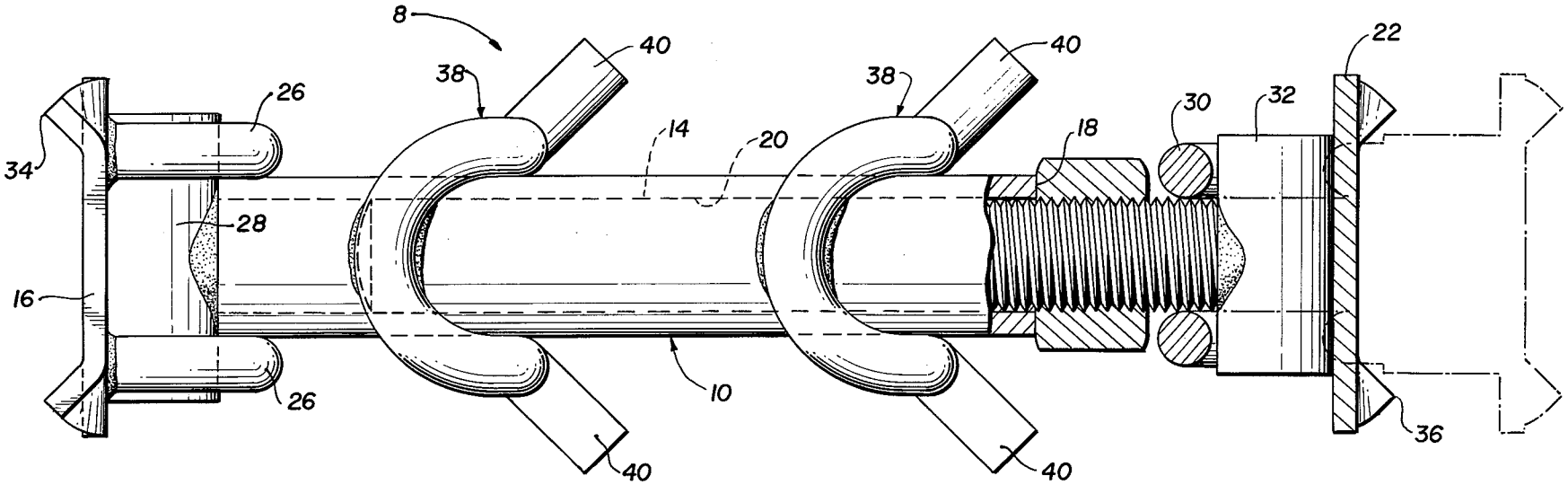
FIG. 3 is a top view of the device of FIG. 2, partially in section.

The compression device illustrated in FIGS. 2–4 includes a central elongated member 10 formed of an outer telescopic element 12 and an inner telescopic element 14. The left end of the outer element 12 is provided with a pivoted brick-engaging foot 16, while the right end of this element 12 is provided with a shoulder 18. A longitudinal bore 20 extends inwardly from shoulder 18.

The inner element 14 has a brick-engaging foot 22 pivotally mounted at its right end. The element 14 is externally threaded and is slidable telescopically within the bore 20 of outer element 12. A nut 24 with internal threads is engaged with the threads on member 14, and bears against the shoulder 18. With this construction, it will be appreciated that rotation of the nut 24 in one direction will extend the length of the elongated member 10 by forcing the inner element 14 outwardly from the bore 20, thus delivering compressive forces to the bricks engaged by the feet 16 and 22.

To enable the device to adapt itself to bricks having different relative inclinations, it is preferred that at least one of the feet 16 or 22 be pivotally mounted on the elongated member 10. As illustrated, both of these feet are so mounted. The foot 16 has a pair of spaced apart C-shaped members 26 engaged loosely about a transverse pivot rod 28 welded or otherwise permanently affixed to the left end of the elongated member 10. In a similar fashion, the foot 22 is provided with C-shaped members 30 which encircle and pivotally engage the transverse pivot rod 32 affixed to the right end of the inner element 14 of the elongated member 10.

Frictional engagement of the feet 16 and 22 with the bricks is promoted by the outturned corners which provide a projecting point as shown at 34 on foot 16 and at 36 on foot 22.

In addition to providing a compressive retention force to the brick during assembly of the structure, the compression device also reinforces the hardened body of cast material. Such reinforcement means is provided by the members 38 which are welded to the exterior surface of the outer element 12 of elongated member 10.

These members are each formed of rod stock, and are bent into a configuration which provides projecting legs 40. As will be observed in FIG. 2, these legs lie at an acute angle with respect to the member 10 to enhance their reinforcement capabilities. FIG. 3 shows that the legs 40 are also divergent with respect to each other, also contributing to their reinforcement function.

Figure 5:
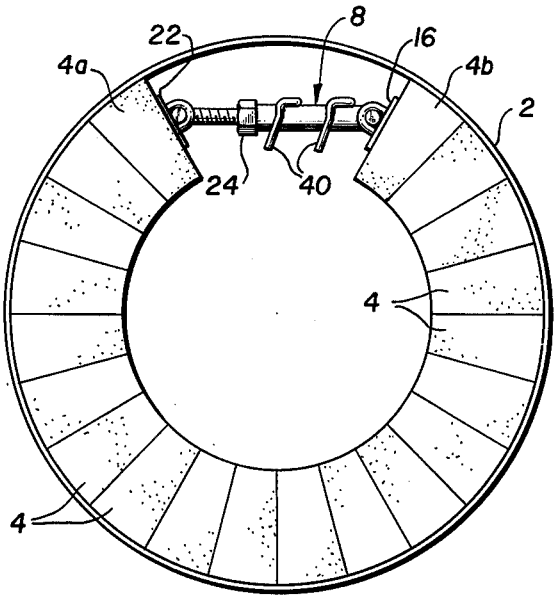
FIG. 5 shows the position of a pipe when installing and extending the compression device.
Figure 6:
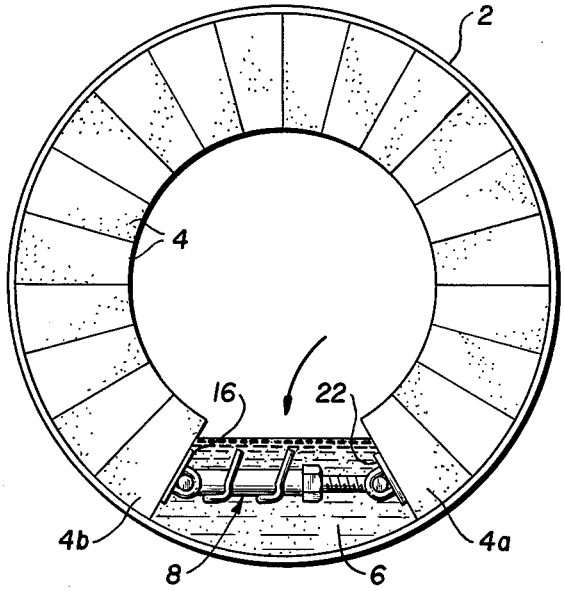
FIG. 6 shows the position of a pipe when casting a hardenable material in the space occupied by the compression device.

From the foregoing, it will be evident that the device is used by first placing the brick 4 in their arcuate pattern within a radially-constraining structure which in the preferred embodiment is the circular shell 2. A space is left between the two uppermost bricks 4*a* and 4*b* as shown in FIG. 5. In this orientation, the device 8 is inserted into the space. The nut 24 is rotated to extend the length of device 8 to compress the bricks 4 together and to hold them firmly against each other and against the internal concave surface of the shell 2. With the bricks held in the desired position, the pipe is rotated 180° to the position shown in FIG. 6, and the space between the bricks 4*a* and 4*b* is then filled with a hardenable fluent material such as ram type plastic refractory or castable refractory. This material is then permitted to harden with the compression device embedded therein, producing the structure illustrated in FIG. 1.

This specification has shown only a preferred embodiment of the invention. The invention may be used in conjunction with any sprung arch, and it may take many forms other than the specific one shown herein. Accordingly, it is emphasized that the scope of the invention is not limited only to the preferred disclosed embodiment, but is encompassing of other devices, structures and methods within the spirit of the claims which follow.

I claim:

1. A method of forming a structure of structural modules such as brick comprising the steps of, placing said structural modules in an arcuate pattern against a concave surface, leaving a space between two mutually facing spaced-apart modules, inserting into said space a compression device, extending the length of the compression device to compress the modules together to hold them firmly against each other and against said concave surface, filling said space with a hardenable fluent material, permitting said material to harden with the compression device embedded therein.

2. The method of claim 1 in which said concave surface is movable, performing said insertion and extension steps while the space is located at an upper portion of said pattern, turning the pattern before said filling step to locate the space at a lower portion of said pattern, and performing the filling step while the space is located at a lower portion of the pattern.

* * * * *